US006397774B1

(12) United States Patent
Pranger

(10) Patent No.: US 6,397,774 B1
(45) Date of Patent: Jun. 4, 2002

(54) FLOATING BOAT HOUSE

(76) Inventor: Leslie J. Pranger, 1719 Country Rd. 23, Waterloo, IN (US) 46793

( * ) Notice: Subject to any disclaimer, the term of this patent is extended or adjusted under 35 U.S.C. 154(b) by 0 days.

(21) Appl. No.: 09/566,752

(22) Filed: May 9, 2000

(51) Int. Cl.[7] ..... B63B 35/44
(52) U.S. Cl. ..... 114/263; 114/266; 114/267
(58) Field of Search ..... 114/263, 266, 114/267, 354, 61.1, 363; 405/219; 135/97, 123, 124; 248/230.8, 62

(56) References Cited

U.S. PATENT DOCUMENTS

| | | | | | |
|---|---|---|---|---|---|
| 1,643,464 | A | | 9/1927 | McCullers | |
| 2,744,483 | A | * | 5/1956 | Rhindress | 114/267 |
| 2,887,975 | A | | 5/1959 | Smith | |
| 2,984,076 | A | | 5/1961 | Bradley | |
| 3,126,855 | A | | 3/1964 | Freeburg | |
| 3,215,108 | A | * | 11/1965 | Otis | 114/267 |
| 4,358,866 | A | * | 11/1982 | Rhodes | 114/363 |
| 4,404,980 | A | * | 9/1983 | Wade | 135/97 |
| 4,683,901 | A | | 8/1987 | Mitchell | |
| 4,768,741 | A | * | 9/1988 | Logsdon | 248/62 |
| 4,920,921 | A | * | 5/1990 | Ochs | 114/267 |
| 5,056,448 | A | * | 10/1991 | Miller, Sr. | 114/61.1 |
| 5,413,066 | A | * | 5/1995 | Spencer, Jr. et al. | 114/354 |
| 5,419,273 | A | | 5/1995 | Culter | |
| 5,595,203 | A | * | 1/1997 | Espinosa | 135/124 |
| 5,775,353 | A | | 7/1998 | Johnson | |
| 5,799,916 | A | * | 9/1998 | Lechner | 248/230.8 |
| 6,062,243 | A | * | 5/2000 | Tuch et al. | 135/124 |

* cited by examiner

*Primary Examiner*—S. Joseph Morano
*Assistant Examiner*—Lars A. Olson
(74) *Attorney, Agent, or Firm*—George Pappas

(57) ABSTRACT

A floating boat house includes a pair of elongate cylindrically shaped floats adapted to float on water and a plurality of frame members attached to the floats in a spaced relation with one another and extending above the floats. A flexible cover extends over and is detachably attachable to the frame members thereby forming a semicircular enclosure. The frame members are detachably attachable to the floats. The floats are made of a plurality of hermetically sealed pipe sections collinearly detachably attachable to one another. The cover includes a doorway and a flexible flap selectively detachably attachable to the cover for selectively opening and closing the doorway. The boat house is generally easily assembled and disassembled as needed for use, storage and transport.

8 Claims, 5 Drawing Sheets

FLOATING BOAT HOUSE

TECHNICAL FIELD

The present invention relates to the field of floating boat houses or enclosures for storing and providing shelter for boats while floating on a body of water. More particularly, the present invention relates to a floating boat house for generally small boats and which can selectively be easily assembled and disassembled.

BACKGROUND OF THE INVENTION

It is desirable to shelter small boats and other pleasure craft from the weather so as to, for example, prevent rain from swamping and/or otherwise damaging the interior of the boat. Boat houses and other shelters have, thus, been constructed and used in the past for storing boats while not in use. Permanent boat house structures tend to be costly as a result of the terrain or shoreline whereat they must be built and the type of construction required to withstand the weather conditions.

Floating boat houses or shelters have previously been devised which eliminate the need for permanent construction along the shoreline. Such boat houses are essentially adapted to float on the water and are tethered or otherwise secured to the lake bottom. An opening is provided for selectively driving the boat in and out of the boat house. Quite often the floating boat house is located adjacent a dock for accessing the boat while within the boat house. Boat houses of this character are, for example, disclosed and shown in U.S. Pat. No. 5,419,273 to Cutler; U.S. Pat. No. 2,984,076 to Bradley; U.S. Pat. No. 2,887,975 to Smith; and, U.S. Pat. No. 1,643,464 to McCullers.

Although prior floating boat houses appear to function sufficiently well for their intended purpose, they are generally bulky and difficult to assemble and disassemble. Such assembly and disassembly is typically required in northern climates whereat the boat house must be removed from the water prior to winter to prevent damage as a result of the lake freezing over.

Accordingly, a need exists for a floating boat house which can easily be assembled and disassembled and, further, which can generally easily be transported as needed and wherein, when assembled, is generally rugged for withstanding the weather and waves.

SUMMARY OF THE INVENTION

It is the principal object of the present invention to overcome the above discussed disadvantages associated with prior floating boat houses.

The present invention overcomes the disadvantages associated with prior floating boat houses by providing a pair of cylindrically shaped floats made of polyvinyl chloride (PVC) plastic adapted to float on water. The floats are preferably made of a plurality of pipe sections which have been capped at their ends and, thus, hermetically sealed. The pipe sections are selectively collinearly attached to one another so as to form the longer float lengths. The pipe sections are selectively detachably attachable to one another.

A plurality of spaced frame members extend above and are connected between the floats. The frame members are connected to the floats with saddles each of which include an arcuate portion adapted to fit over the cylindrical floats and a sleeve orthogonal to the arcuate portion whereat the frame members are attached. Each of the saddles are detachably attachable to the floats with an elongate strap attached to a side of the saddle and adapted to extend around the float. A draw latch on the other side of the saddle is adapted to attach to and draw the strap for tightly attaching the saddle to the float. In an alternate embodiment, the saddle arcuate portion is resilient and includes a longitudinal gap. The gap can selectively be expanded for snapping the arcuate portion over and around the cylindrical shaped float for attachment thereto. The frame members are preferably made of at least two generally arcuate sections which are detachably attachable to one another at one end and are attached to the saddle orthogonal sleeves at their other end.

A flexible cover made of, for example, canvas or plastic is stretched over the top of the frame members and is attached to the frame members with snaps or pile and loop material such as that sold under the brand name "Velcro". The frame members and cover form a semicircular enclosure over the water with openings at the longitudinal ends whereat a boat may enter or exit. A doorway is provided in the cover so that, when the boat house is placed adjacent a dock, the enclosure can be accessed therethrough. A flexible flap is provided and is selectively detachably attachable on the cover over the doorway for thereby selectively opening and closing the doorway.

In one form thereof, the present invention is directed to a floating boat house including a pair of cylindrically shaped floats adapted to float on water. A plurality of frame members extend above and are connected between the floats. A flexible cover extends over the frame members thereby forming an enclosure. A saddle is provided between each of the frame members and the floats. The saddles include an arcuate portion fitted over the cylindrical floats and a sleeve orthogonal to the arcuate portion whereat the frame members are attached.

In one form thereof, the present invention is directed to a floating boat house including a pair of cylindrically shaped floats adapted to float on water. A plurality of frame members extend above and are connected between the floats. A flexible cover extends over the frame members thereby forming an enclosure. Each of the cylindrically shaped floats include a plurality of plastic pipes capped at their ends to form hermetically sealed sections. The sections are placed end to end and are collinearly attached to one another.

In one form thereof, the present invention is directed to a floating boat house including a pair of cylindrically shaped floats adapted to float on water. A plurality of frame members extend above and are connected between the floats. A flexible cover extends over the frame members thereby forming an enclosure. A doorway is provided in the cover for selectively gaining entry into and out of the enclosure.

In one form thereof, the present invention is directed to a floating boat house including a pair of cylindrically shaped floats adapted to float on water. A plurality of frame members extend above and are connected between the floats. A flexible cover extends over the frame members thereby forming an enclosure. The frame members are made up of at least two generally arcuate sections detachably attachable to one another at one end and attached to the floats at their other end.

BRIEF DESCRIPTION OF THE DRAWINGS

The above-mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DETAILED DESCRIPTION OF SPECIFIC EMBODIMENTS

Figure 1:
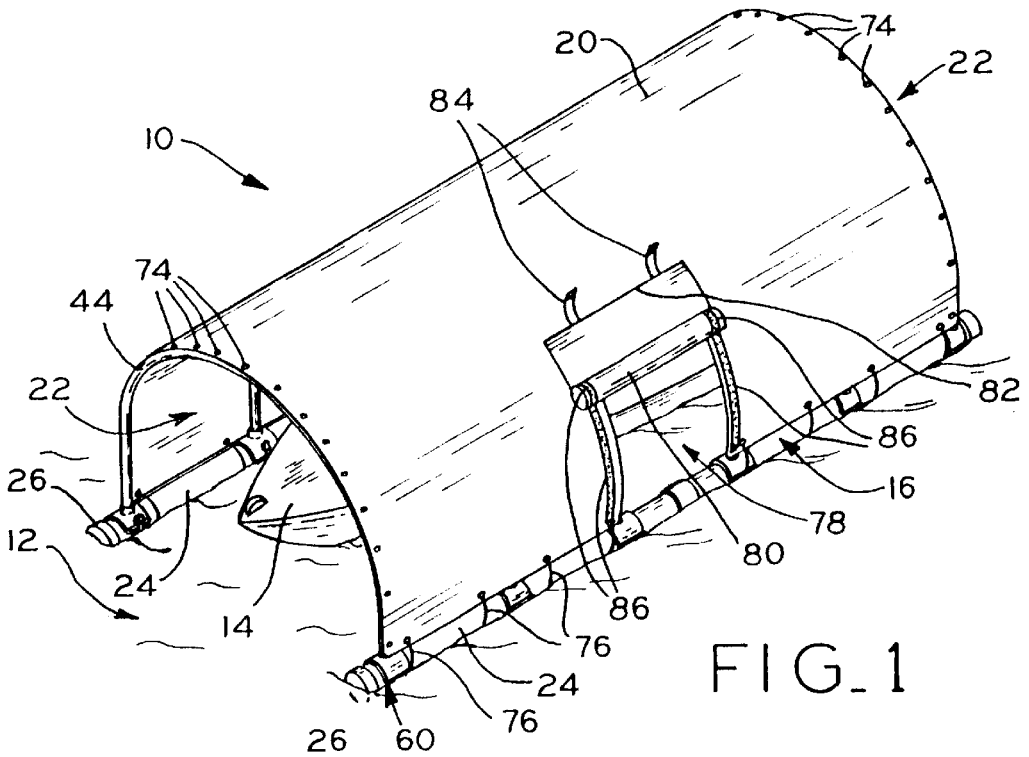
FIG. 1 is a perspective view of the floating boat house constructed in accordance with the principles of the present invention.

Referring initially to FIG. 1, a floating boat house constructed in accordance with the principles of the present invention is shown and generally designated by the numeral 10. Boat house 10 is adapted to float on a body of water 12 such as a pond or lake and enclosing or sheltering and protecting a boat 14 from the elements/weather. Boat house 10 is secured and prevented from excessive horizontal motion by tethering to dock or to anchors or weights at the bottom of the lake (not shown). Boat 14 can be tethered inside the boat house 10 with a rope extending and attached to the boat house itself, the dock, or anchors at the bottom of the lake.

Floating boat house 10 is generally lightweight and can be easily assembled and disassembled. In general, boat house 10 includes a pair of cylindrically shaped floats 16 adapted to float on the water 12. A plurality of arcuate or semicircular shaped frame members 18 are attached in space relation to one another to floats 16. A flexible cover 20 made of water resistant canvas, plastic or other water resistant materials is stretched and extends over the frame members 18 and is attached thereto, as best seen in FIG. 1, so as to form a generally semicircular elongate enclosure with openings 22 at each end thereof wherethrough a boat 14 can selectively enter or exit.

Figure 6:
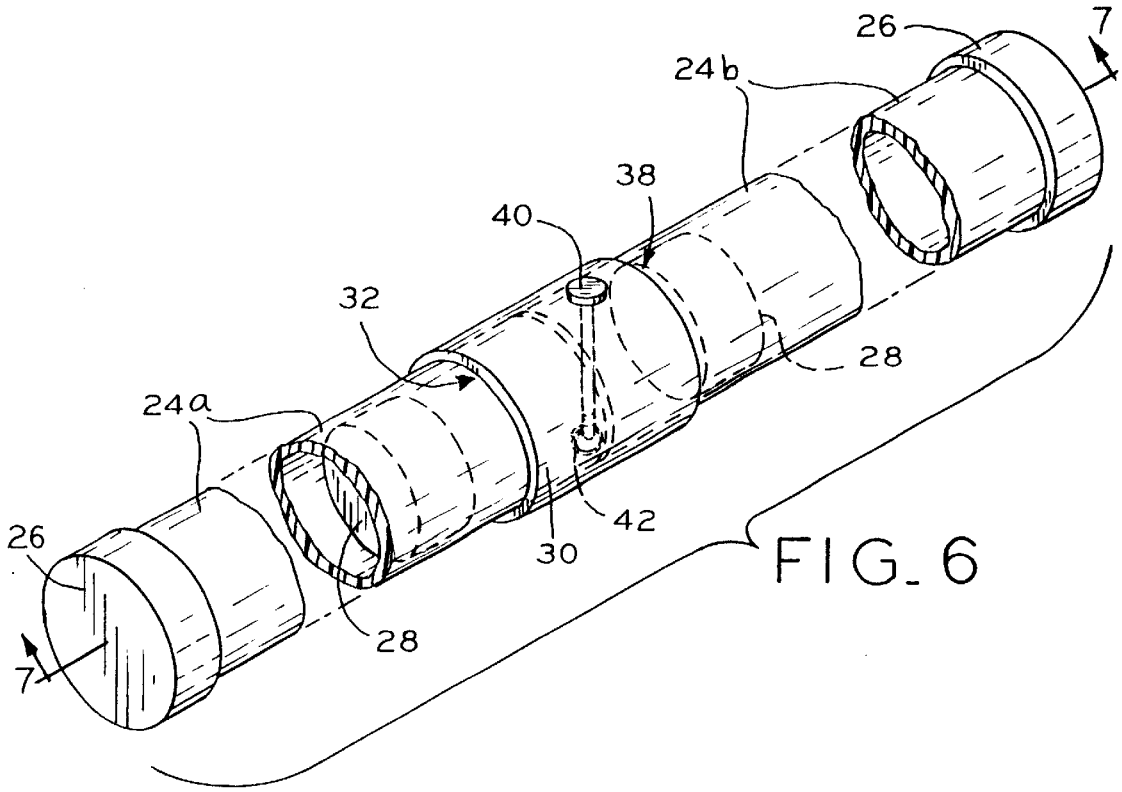
FIG. 6 is a perspective view of a cylindrical float of the floating boat house constructed in accordance with the principles of the present invention.
Figure 7:
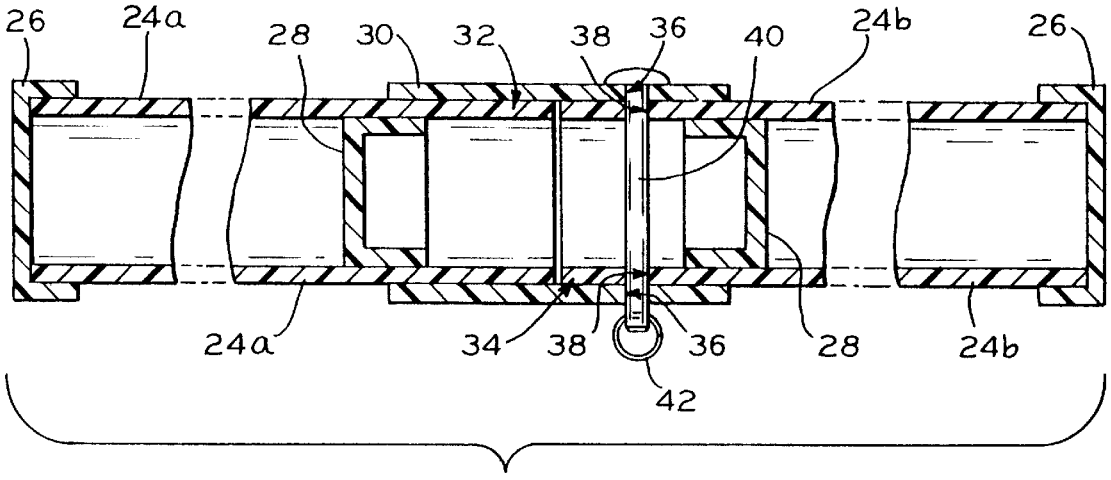
FIG. 7 is a cross-sectional view of the cylindrical float shown in FIG. 6 taken generally along line 7—7.
Figure 8:
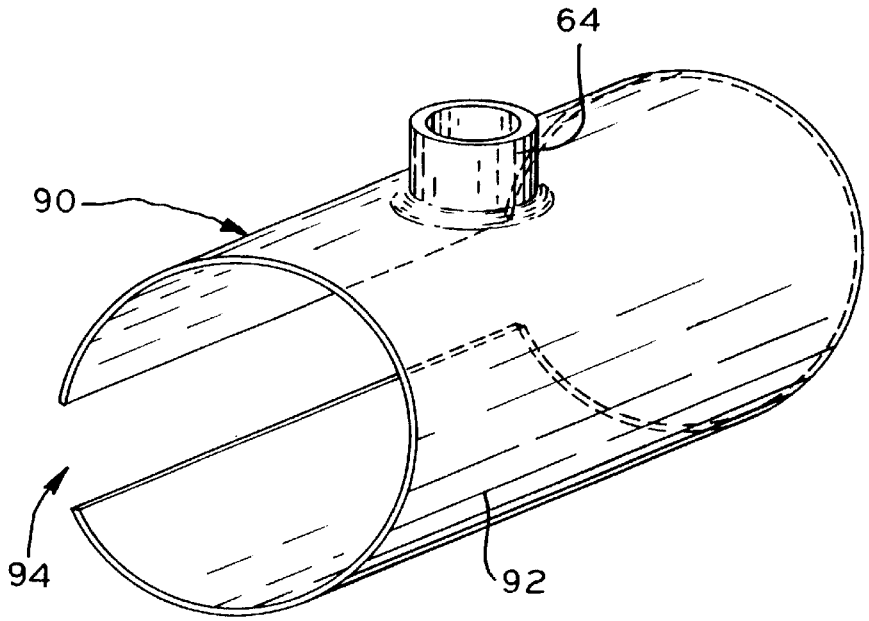
FIG. 8 is a perspective view of another embodiment of a saddle constructed in accordance with the principles of the present invention.

As best seen in FIGS. 6 and 7, cylindrical floats 16 are preferably made of a pair of polyvinyl chloride (PVC) cylindrical pipe sections 24 which have been hermetically sealed at one end with a cap 26 and at the other end with a plug 28. Caps 26 and plugs 28 are affixed in their respective positions with contact cement or other suitable means so as to trap air within the pipe sections 24. A coupling member 30 extends over and is affixed with contact cement to the pipe section 24*a* shown on the left in FIG. 7 so as to extend longitudinally beyond the inner end 32 of that section 24*a*. The inner end 34 of the other pipe section 24*b* shown on the right in FIG. 7 is adapted to be slidingly received within the coupling 30 as shown, but is not permanently affixed thereto. Rather, coupling 30 is provided with holes 36 adapted to be aligned with holes 38 located at the inner end 34 of the pipe section 24*b* for receiving a pin 40 therethrough. After pin 40 has been inserted through aligned holes 36 and 38, a retaining ring 42 is detachably attached at the pin end in a known and customary manner for preventing inadvertent removal thereof. Preferably, each of the pipe sections 24 are made of 4 or 6 inch diameter PVC plastic pipe and have a length of about 10 feet. In this manner, when disassembled, sections 24 are generally lightweight and easy to handle. After assembly of sections 24, the floats 16 are, thus, about 20 feet in length.

Figure 2:
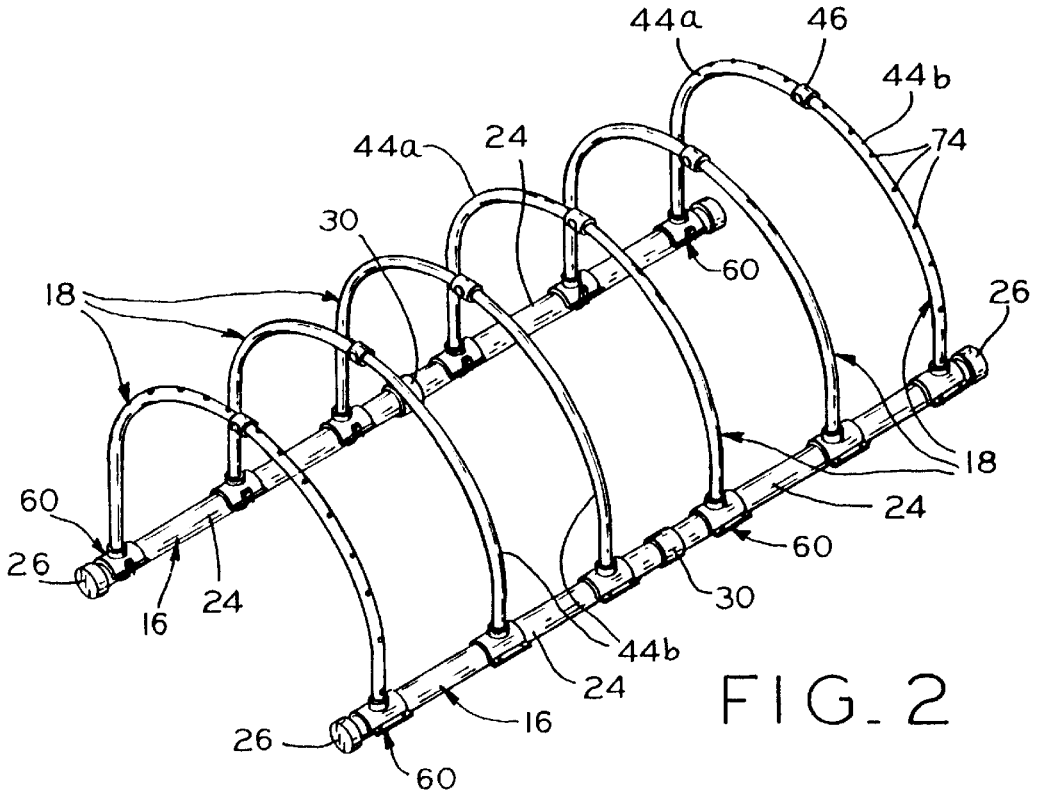
FIG. 2 is a perspective view of the floating boat house shown in FIG. 1 and with the cover removed.
Figure 3:
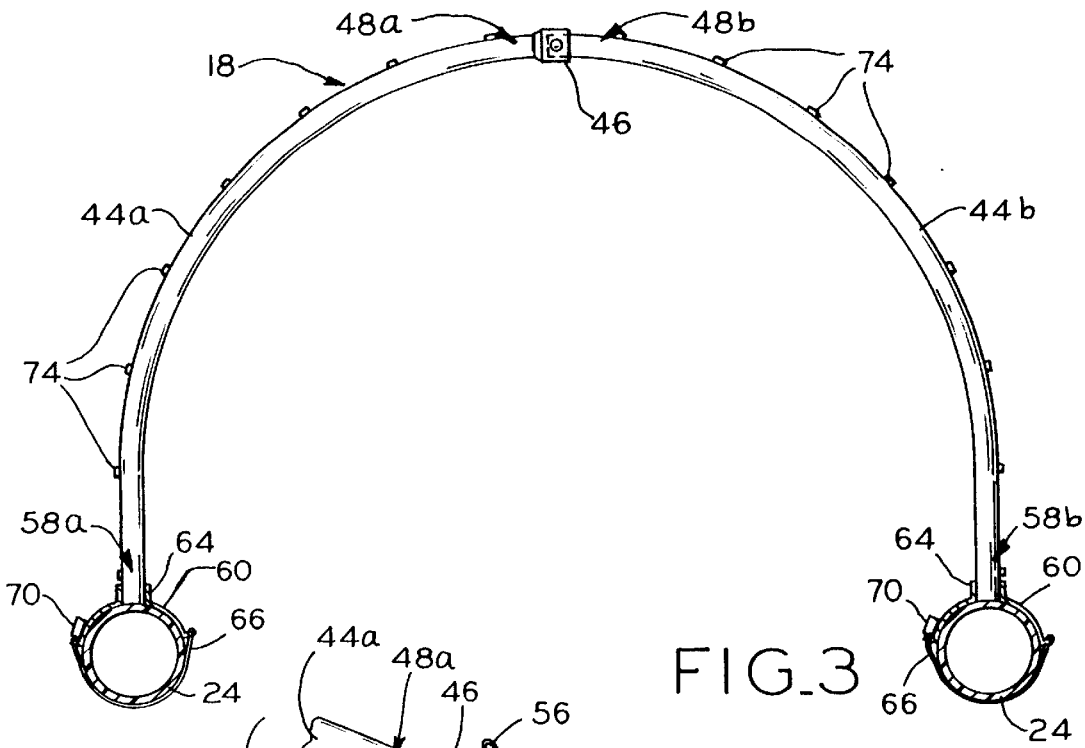
FIG. 3 is a front elevation view of the floating boat house shown in FIG. 2.
Figure 4:
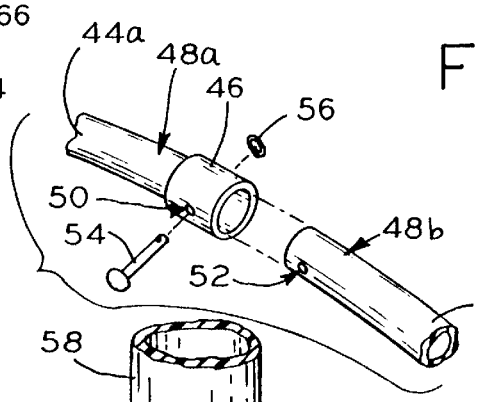
FIG. 4 is an exploded perspective view of the connection between the frame members in accordance with the principles of the present invention.

Each of the frame members 18 are also preferably made of PVC plastic and are made of two generally arcuate sections 44*a* and 44*b*. Arcuate section 44*a* is provided with a coupling 46 attached at its one upper end 48*a* with contact cement or other suitable means. The upper end 48*b* of arcuate section 44*b* is adapted to be received into coupling 46 as best seen in FIGS. 3 and 4. Coupling 46 is provided with holes 50 adapted to be aligned with holes 52 extending through the upper end 48*b* of arcuate section 44*b*. A pin 54 is received through aligned holes 50 and 52 for thereby selectively detachably attaching arcuate sections 44*a* and 44*b* together as shown in FIGS. 2 and 3. A retaining ring 56 is selectively detachably attachable to the end of pin 54 in a known and customary manner so as to prevent pin 54 from inadvertently being removed from aligned holes 50 and 52. It is noted that arcuate sections 44*a* and 44*b* are preferably made of PVC plastic pipe of about 1 to 1½ inch in diameter and are permanently arcuately shaped by heating to a sufficient temperature and allowing the PVC plastic to thermally set with an arcuate shape as generally shown.

Figure 5:
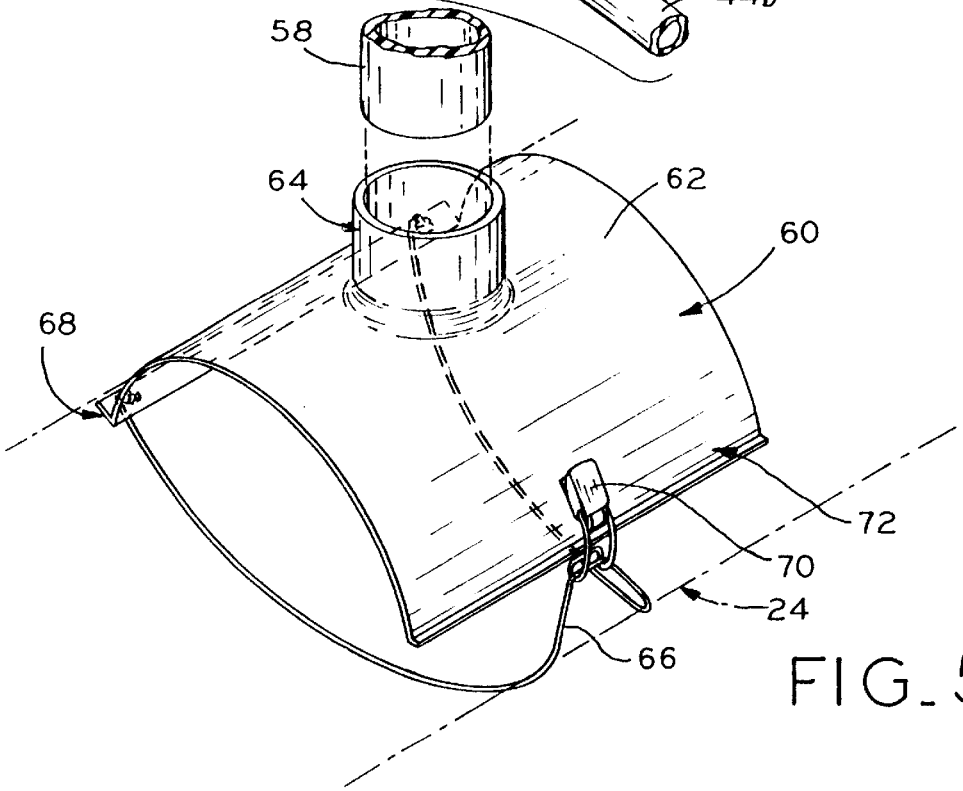
FIG. 5 is a perspective view of a frame member and saddle attached to a float in accordance with the principles of the present invention.

At the lower ends 58*a* and 58*b*, the arcuate sections 44*a* and 44*b* are selectively detachably attachable to the floats 16 with saddles 60. As best seen in FIG. 5, saddles 60 include an arcuate portion 62 adapted to fit over the outer surface of a pipe section 24 of floats 16. A sleeve 64 extends orthogonally from the arcuate portion 62 as shown and is adapted to receive a lower end 58 of a frame member 44. Preferably, the lower ends 58 of frame members 44 are affixed within sleeves 64 with contact cement or other suitable means. Saddles 60 further include an elongate strap 66 attached to a side edge 68 of arcuate portion 62 and adapted to extend around a float pipe section as shown. A draw latch 70 is affixed to the other side edge 72 of arcuate portion 62 and is adapted to selectively attach to and draw strap 66 tight around the float pipe section 24. Draw latch 70 is preferably made of stainless steel and is attached to the side edge 72 of the saddle arcuate portion 62 with screws or other suitable means. As can be appreciated, saddle 60 in conjunction with straps 66 and draw latch 70 provide a generally easy and quick method for detachably attaching the frame members 44 to the floats 16 in a spaced relation with one another as shown in FIG. 2.

As shown in FIGS. 1, 2 and 3, the cover 20 is selectively detachably attachable to at least the outermost frame members 44 with corresponding snap members 74 which are attached to the longitudinal edge of cover 20 and the upper surface of the outermost frame members 44. It is contemplated that the snap members 74 can be replaced with a pile and loop fastening system such as that provided under the brand name Velcro, for more quickly and easily detachably attaching the cover longitudinal edge to the outermost frame members 44. Additionally, ties 76 are provided along the cover lower horizontal edges for detachably tieing the lower horizontal edge thereof to the cylindrical floats 16. As can be appreciated, the cover 20 can generally easily and quickly be attached or detached to the frame members and, while on the frame members 18, provides boat 14 with the necessary protection from the weather.

A doorway 78 is provided through the cover 20 as shown for selectively gaining entry into and out of the enclosure. Preferably, if the boat house 10 is secured adjacent a dock, the doorway 20 is located next to the dock so that boat 14 is directly accessible from the dock. A flexible flap 80 is detachably attachable to the cover 20 over the doorway 78 for thereby selectively opening and closing the doorway 78. Preferably, as shown, flap 80 is attached to the cover 20 along its upper edge 82 and can be selectively rolled up for opening the doorway 78. Tie straps 84 are attached to the cover 20 along the edge 82 for selectively tieing and retaining the rolled flap 80 thereat. Tie straps 84 can also be provided with pile and loop fastening means such as that sold under the brand name Velcro, for more easily and quickly retaining the rolled flap 80 thereat. Additionally, respective pile and loop strips 86 are provided along the vertical edges of the doorway 78 and flap 80 so that, when flap 80 is rolled down and over the doorway 78, the respective pile and loop strips 86 attach to one another and retain the flap 80 over the doorway 78 thereby keeping the doorway closed. For opening the doorway, the flap 80 is merely pulled away separating the respective pile and loop strips 86 from one another and is rolled upwardly whereat it is retained with straps 84.

Figure 9:
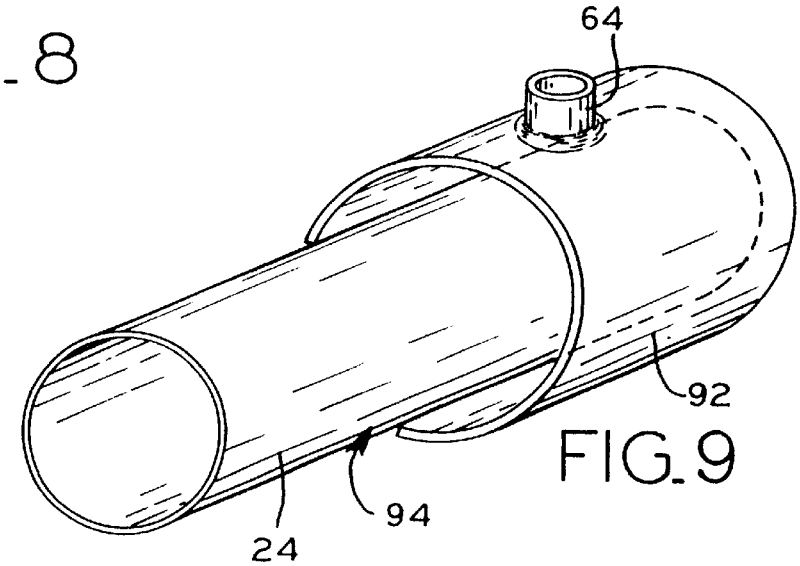
FIG. 9 is a perspective view of the saddle of FIG. 8 and wherein the saddle arcuate portion has been expanded for placement over a float pipe.
Figure 10:
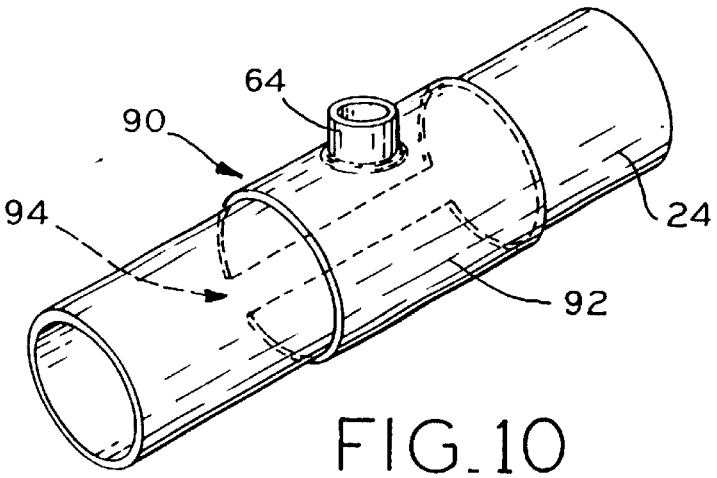
FIG. 10 is a perspective view of the saddle of FIG. 8 shown snapped over and attached to a float pipe.

In an alternate embodiment, the saddles 60 are replaced with the saddles shown in FIGS. 8–12 and generally designated by the numeral 90. Saddles 90 similarly include an arcuate portion 92 adapted to fit over the outer surface of a pipe section 24 of floats 16. Arcuate portion 92, however, is adapted to extend substantially around the pipe section 24 except for a longitudinally extending gap or opening 94. The size of gap of 94 along with the thickness and flexibility of arcuate portion 92 are sized such that the gap can be expanded as shown in FIG. 9 so that the arcuate portion may be snapped over the pipe 24. The arcuate portion 92 is sufficiently flexible, yet retains its original form such that, after it has been expanded and snapped over pipe 24, it hugs or otherwise remains secured around the pipe 24 as shown in FIG. 10. To provide a more solid frictional engagement, the outer diameter of pipe 24 is preferably slightly larger than the inside diameter of the arcuate portion 92 when arcuate portion 92 is allowed to snap on and over the pipe 24.

Figure 11A:
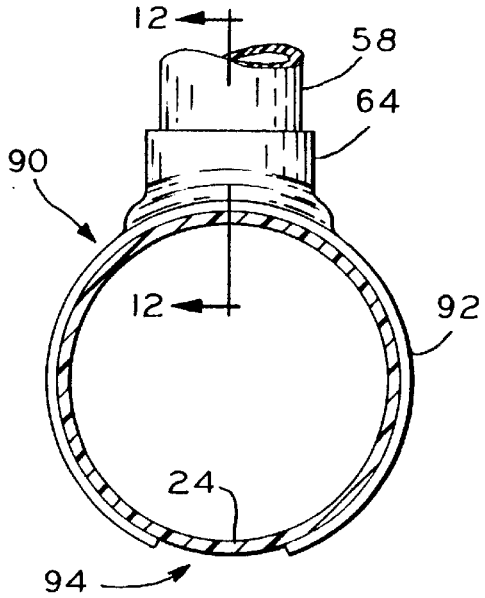
FIGS. 11*a*, 11*b* and 11*c* are end views showing the saddle of FIG. 8 on a float pipe and depicting various locations of the gap in the arcuate portion; and, FIG. 12 is a cross-sectional view of the saddle, sleeve and frame member lower end shown in FIG. 11*a* taken generally along line 12—12.
Figure 11B:
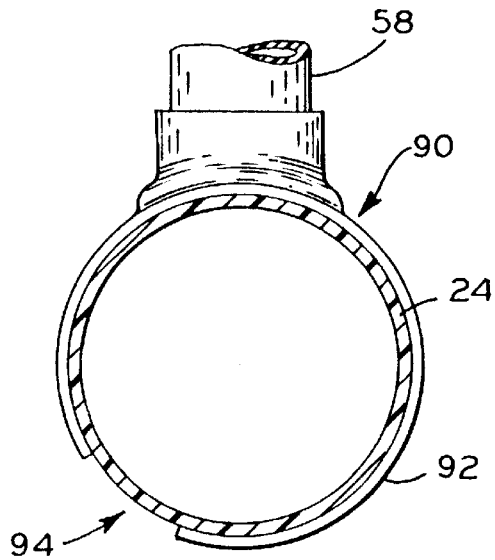
Figure 11C:
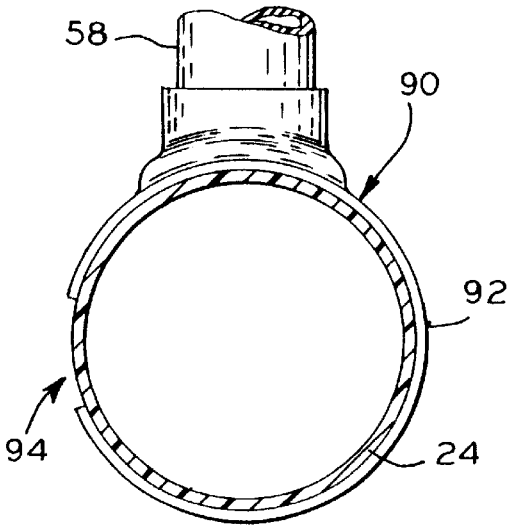

It is further noted that, as shown in FIGS. 11*a*, 11*b* and 11*c*, the gap 94 can be located radially at various positions with respect to the sleeve 64 thereof. In this manner, the force at which saddle 90 will break away from pipe 24, for example, in the event of excessive wind, can be varied as may be desired. That is, by locating the gap 94 furthest away; or 180 degrees radially from sleeve 64, the break-away force of saddle 90 from pipe 24 is minimized. If gap 94 is located radially closer to sleeve 64, the break-away force is significantly increased. Thus, the break-away force of the saddle shown in FIG. 11*b* will be greater than the saddle of FIG. 11*a*, and the break-away force of saddle 90 of FIG. 11*c* will be greater than the saddle of FIG. 11*b*.

Figure 12:
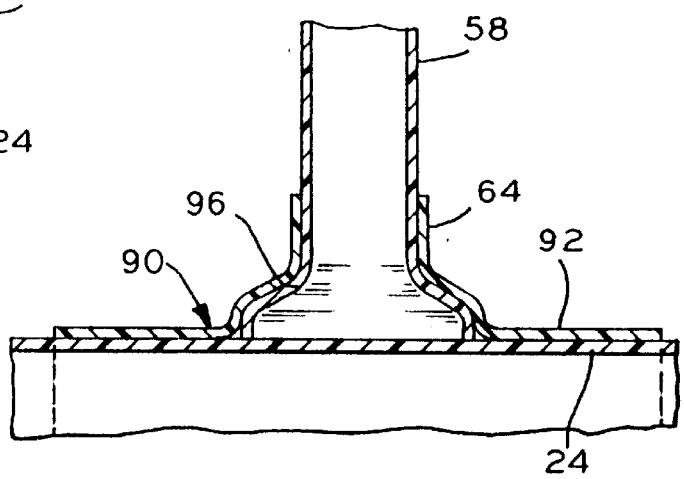

Referring now to FIG. 12, an alternate embodiment of sleeve 64 is shown. Here, sleeve 64 is generally mushroom-shaped in cross section as shown for receiving therein the mushroom-shaped portion at the end of lower end 58 of an arcuate section 44. Here, the lower end 58 can, but is not required, to be welded to the sleeve 64. Rather, the arcuate section 44 is threaded up through sleeve 64 until the mushroom portion 96 thereof at the lower end 58 abuts the mating inner surface of the sleeve 64. Thus, after the saddle 90 is snapped onto a pipe 24, the mushroom portion 96 is sandwiched between the inner mating surface of the sleeve 64 and pipe 24 thereby securing arcuate section 44 to saddle 90 and pipe 24. As can be appreciated, the embodiment utilizing saddle 90 and arcuate sections 44 having lower ends 58 which are mushroom-shaped makes assembly of the floating boat house yet easier and quicker while, nevertheless, providing a rugged assembly for withstanding the weather and waves.

While the invention has been described as having specific embodiments, it will be understood that it is capable of further modifications. This application, is therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A floating boathouse comprising:

a pair of cylindrically shaped floats adapted to float on water;

a plurality of frame members extending above and connected between said floats;

a flexible cover extending over said frame members thereby forming an enclosure;

wherein a saddle is provided between each of said frame members and said floats, said saddles including an arcuate portion fitted over said cylindrical floats and a sleeve orthogonal to said arcuate portion whereat said frame members are attached; and, wherein said floats comprise a plurality of elongate capped pipes placed end to end and attached to one another.

2. A floating boat house comprising:

a pair of cylindrically shaped floats adapted to float on water;

a plurality of frame members extending above and connected between said floats;

a flexible cover extending over said members thereby forming an enclosure;

wherein a saddle is provided between each of said frame members and said floats, said saddles including an arcuate portion fitted over said cylindrical floats and a sleeve orthogonal to said arcuate portion where at said frame members are attached; and wherein each said cylindrical shaped floats include a plurality of plastic pipes capped at their ends to form hermetically sealed sections, said sections placed end to end and collinearly attached to one another.

3. A floating boat house comprising:

a pair of cylindrically shaped floats adapted to float on water;

a plurality of frame members extending above and connected between said floats;

a flexible cover extending over said frame members thereby forming an enclosure; and, wherein each of said cylindrically shaped floats include a plurality, of plastic pipes capped at their ends to form hermetically sealed sections, said sections placed end to end and collinearly attached to one another.

4. The floating boat house of claim 3, wherein said sections are attached to one another with a coupling attached to an end of a section and wherein another section is selectively detachably attached to said coupling.

5. The floating boat house of claim 3, further comprising means for detachably attaching said sections to one another.

6. The floating boat house of claim 3, wherein said frame members comprise at least two generally arcuate sections detachably attachable to one another at one end and connected to said floats at their other end.

7. The floating boat house of claim 3, further comprising a doorway in said cover for selectively gaining entry into and out of said enclosure.

8. The floating boat house of claim 7, wherein said doorway comprises a flexible flap selectively detachably attachable to said cover for selectively opening and closing said doorway.

* * * * *

UNITED STATES PATENT AND TRADEMARK OFFICE

CERTIFICATE OF CORRECTION

PATENT NO. : 6,397,774 B1
DATED : June 4, 2002
INVENTOR(S) : Leslie J. Pranger

It is certified that error appears in the above-identified patent and that said Letters Patent is hereby corrected as shown below:

Column 5,
Line 66, change “away;” to -- away, --.

Column 6,
Line 56, after “said” insert -- frame --.

Column 7,
Line 9, after “plurality” delete -- , --.

Signed and Sealed this

Eighth Day of October, 2002

*Attest:*

*Attesting Officer*

JAMES E. ROGAN
*Director of the United States Patent and Trademark Office*